US012098473B2

(12) United States Patent
Kitayaporn et al.

(10) Patent No.: US 12,098,473 B2
(45) Date of Patent: Sep. 24, 2024

(54) COMPOSITION FOR COBALT PLATING COMPRISING ADDITIVE FOR VOID-FREE SUBMICRON FEATURE FILLING

(71) Applicant: BASF SE, Ludwigshafen am Rhein (DE)

(72) Inventors: Sathana Kitayaporn, Hillsboro, OR (US); Charlotte Emnet, Ludwigshafen (DE); Dieter Mayer, Ludwigshafen (DE); Nadine Engelhardt, Ludwigshafen (DE); Marco Arnold, Ludwigshafen (DE); Lucas Benjamin Henderson, Ludwigshafen (DE); Alexander Fluegel, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 38 days.

(21) Appl. No.: 17/312,737

(22) PCT Filed: Dec. 10, 2019

(86) PCT No.: PCT/EP2019/084468
§ 371 (c)(1),
(2) Date: Jun. 10, 2021

(87) PCT Pub. No.: WO2020/126687
PCT Pub. Date: Jun. 25, 2020

(65) Prior Publication Data

US 2022/0018035 A1 Jan. 20, 2022

Related U.S. Application Data

(60) Provisional application No. 62/784,258, filed on Dec. 21, 2018.

(51) Int. Cl.
*C25D 3/18* (2006.01)
*C25D 3/12* (2006.01)
(Continued)

(52) U.S. Cl.
CPC ..... *C25D 3/18* (2013.01); *C25D 3/12* (2013.01); *C25D 5/18* (2013.01); *C25D 7/123* (2013.01)

(58) Field of Classification Search
CPC ..... C25D 3/12–18
See application file for complete search history.

(56) References Cited

U.S. PATENT DOCUMENTS 3,753,872 A * 8/1973 Köhl ..... C25D 3/12 205/280
4,749,449 A * 6/1988 Scott ..... C25D 5/022 205/136
(Continued)

FOREIGN PATENT DOCUMENTS

CN 103038390 A 4/2013
EP 3781728 A1 2/2021
(Continued)

OTHER PUBLICATIONS

Wang, Machine Translation and Original, CN 101619471 A (Year: 2010).*
(Continued)

*Primary Examiner* — Hosung Chung
(74) *Attorney, Agent, or Firm* — Armstrong Teasdale LLP

(57) ABSTRACT

Described herein is a composition including metal ions consisting essentially of cobalt ions, and a specific monomeric and polymeric suppressing agent including a carboxylic, sulfonic, sulfinic, phosphonic, or phosphinic acid functional groups which show a suppressing effect that is required for void-free bottom-up filling of nanometer-sized recessed features.

19 Claims, 4 Drawing Sheets

(51) Int. Cl.
*C25D 5/18* (2006.01)
*C25D 7/12* (2006.01)

(56) References Cited

U.S. PATENT DOCUMENTS

| | | | | |
|---|---|---|---|---|
| 5,149,566 | A * | 9/1992 | Morton | C23C 18/1616 427/236 |
| 6,024,857 | A * | 2/2000 | Reid | C25D 3/38 205/125 |
| 7,407,689 | B2 | 8/2008 | Joshi et al. | |
| 7,752,996 | B2 | 7/2010 | Dordi et al. | |
| 8,828,863 | B1 | 9/2014 | Lee et al. | |
| 9,593,423 | B2 | 3/2017 | Mori et al. | |
| 2006/0251800 | A1 * | 11/2006 | Weidman | H01L 21/76877 257/E21.585 |
| 2009/0188805 | A1 | 7/2009 | Moffat et al. | |
| 2010/0126849 | A1 * | 5/2010 | Lopatin | C25D 5/08 204/275.1 |
| 2011/0163449 | A1 | 7/2011 | Kelly et al. | |
| 2014/0183738 | A1 | 7/2014 | Jezewski et al. | |
| 2016/0273117 | A1 * | 9/2016 | Doubina | C25D 3/18 |
| 2017/0154787 | A1 | 6/2017 | Sakashita et al. | |
| 2018/0118951 | A1 * | 5/2018 | Seelmann-Eggebert | C09C 3/10 |

FOREIGN PATENT DOCUMENTS

| | | | | |
|---|---|---|---|---|
| GB | 2100752 | A | 1/1983 | |
| WO | WO-2016062880 | A2 * | 4/2016 | A01N 25/26 |
| WO | 2019097044 | A1 | 5/2019 | |

OTHER PUBLICATIONS

Lee, et al., "Superconformal Electrodeposition of Co and Co—Fe Alloys Using 2-Mercapto-5-benzimidazolesulfonic Acid", Journal of the Electrochemical Society, vol. 156, Issue 8, Jun. 10, 2009, pp. D301-D309.

Sugama, et al.,"Advanced poly(acrylic)acid-modified zinc phosphate conversion coatings: use of cobalt and nickel cations", Surface and Coatings Technology, vol. 50, Issue 2, Feb. 6, 1992, pp. 89-95.

International Search Report and Written Opinion for corresponding PCT/EP2019/084468 mailed Mar. 27, 2020, 31 Pages.

* cited by examiner

COMPOSITION FOR COBALT PLATING COMPRISING ADDITIVE FOR VOID-FREE SUBMICRON FEATURE FILLING

CROSS-REFERENCE TO RELATED APPLICATIONS

This application is a U.S. National Phase Application of International Patent Application No. PCT/EP2019/084468, filed Dec. 10, 2019, which claims priority to U.S. Provisional Patent Application No. 62/784,258, filed Dec. 21, 2018, the entire contents of which are hereby incorporated by reference herein.

The present invention relates to a composition for cobalt plating comprising cobalt ions comprising an agent for void-free filling of recessed features on semiconductor substrates.

BACKGROUND OF THE INVENTION

Filling of small features, such as vias and trenches, by metal electroplating is an essential part of the semiconductor manufacture process. It is well known, that the presence of organic substances as additives in the electroplating bath can be crucial in achieving a uniform metal deposit on a substrate surface and in avoiding defects, such as voids and seams, within the metal lines.

For copper electroplating the void-free filling of submicrometer-sized interconnect features by using additives to ensure bottom-up filling is well known in the art.

For conventional nickel electroplating on substrates like metals, metal alloys, and metallized polymers, particularly copper, iron, brass, steel, cast iron or chemically deposited copper or nickel on polymer surfaces brightening additives comprising acetylenic compounds are known.

With further decreasing aperture size of recessed features like vias or trenches the filling of the interconnects with copper becomes especially challenging, also since the copper seed deposition by physical vapor deposition (PVD) prior to the copper electrodeposition might exhibit inhomogeneity and non-conformity and thus further decreases the aperture sizes particularly at the top of the apertures. Furthermore, it becomes more and more interesting to substitute copper by cobalt since cobalt shows less electromigration into the dielectric.

For cobalt electroplating several additives were proposed to ensure void-free filling of submicrometer-sized features. US 2011/0163449 A1 discloses a cobalt electrodeposition process using a bath comprising a cobalt deposition-inhibiting additive, such as saccharin, coumarin or polyethyleneimine (PEI). US 2009/0188805 A1 discloses a cobalt electrodeposition process using a bath comprising at least one accelerating, inhibiting, or depolarizing additive selected from polyethyleneimine and 2-mercapto-5-benzimidazolesulfonic acid.

On the other hand, unpublished European patent application No. 17202568.6 discloses monomeric and polymeric compounds comprising a carboxylic, sulfonic, phosphonic, or sulfinic acid functional groups, in particular polyacrylic acid and its copolymers.

There is still a need for a cobalt electroplating composition that allows a void-free deposition of cobalt in small recessed features, such as vias or trenches, of semiconductor substrates.

It is therefore an object of the present invention to provide an electroplating bath that is capable of providing a substantially void-free filling, preferably void-free and seam-free filling of features on the nanometer and/or on the micrometer scale with cobalt or a cobalt alloy.

SUMMARY OF THE INVENTION

Surprisingly, it was found that, besides is leveling capabilities, specific monomeric and polymeric compounds comprising a carboxylic, sulfonic, sulfinic, phosphonic, or phosphinic acid functional groups also have a suppressing effect that is required for void-free bottom-up filling of nanometer-sized recessed features. The present invention provides a new class of highly effective additives that provide substantially void free filling of nanometer-sized interconnect features with cobalt or cobalt alloys. Any further suppressing agents (and optionally leveling agents) may be avoided in this way.

Therefore, the present invention provides a composition comprising (a) metal ions consisting essentially of cobalt ions, and (b) a suppressing agent comprising the structure of formula S1

$$[B]_n[A]_p \quad \text{(S1)}$$

or having the structure of formula S2

(S2)

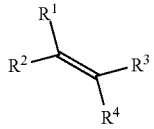

or comprising the structure of formula S3a or S3b (S3a)

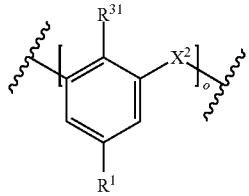

(S3b)

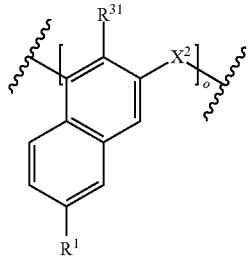

or having the structure of formula S4

$$Ø\text{-}R^1 \quad \text{(S4)}$$

and their salts, wherein $R^1$ is selected from $X^1$—CO—O—$R^{11}$, $X^1$—$SO_2$—O—$R^{11}$, $X^1$—$PR^{11}O(OR^{11})$, $X^1$—$P(OR^{11})_2$, $X^1$—$PO(OR^{11})_2$, and $X^1$—SO—O—$R^{11}$;

$R^2$, $R^3$, $R^4$ are independently selected from $R^1$ and (i) H, (ii) aryl, (iii) $C_1$ to $C_{10}$ alkyl (iv) arylalkyl, (v) alkylaryl, and (vi) —$(O—C_2H_3R^{12})_m$—OH, with the proviso that if one of $R^2$, $R^3$ or $R^4$ are selected from $R^1$, the other groups $R^2$, $R^3$ or $R^4$ are different from $R^1$, Ø is a $C_6$ to $C_{14}$ carbocyclic or a $C_3$ to $C_{10}$ nitrogen or oxygen containing heterocyclic aryl group, which may be unsubstituted or substituted by up to three $C_1$ to $C_{12}$ alkyl groups or up to two OH, $NH_2$ or $NO_2$ groups, $R^{31}$ is selected from $R^1$, H, $OR^{32}$ and $R^{32}$, $R^{32}$ is selected from (i) H and (ii) $C_1$ to $C_6$ alkyl, $X^1$ is a divalent group selected from (i) a chemical bond (ii) aryl, (iii) $C_1$ to $C_{12}$ alkandiyl, which may be interrupted by one or more O atoms, (iv) an arylalkyl group —$X^{12}$—$X^{11}$—, (v) an alkylaryl group —$X^{11}$—$X^{12}$—, and (vi) —(O—$C_2H_3R^{12}$)$_m$O—, $X^2$ is (i) a chemical bond, or (ii) methanediyl, $R^{11}$ is selected from H and $C_1$ to $C_4$ alkyl, $R^{12}$ is selected from H and $C_1$ to $C_4$ alkyl, $X^{12}$ is a divalent aryl group, $X^{11}$ is a divalent $C_1$ to $C_{15}$ alkandiyl group, A is a co-monomer selected from vinyl alcohol, which may optionally be (poly)ethyoxylated, acrylonitrile, styrene and acrylamide, B is selected from formula S1a (S1a)

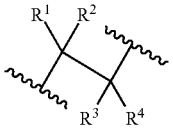

n is an integer from 2 to 10 000, m is an integer from 2 to 50, is an integer from 2 to 1 000, and p is 0 or an integer from 1 to 10 000, wherein the composition is essentially free of any dispersed particles, and wherein the composition is essentially free of any further suppressing agent.

The invention further relates to the use of a metal plating bath comprising a composition as defined herein for depositing cobalt or cobalt alloys on substrates comprising recessed features having an aperture size of 100 nanometers or less, in particular 20 nm or less, 15 nm or less or even 7 nm or less.

The invention further relates to a process for depositing a layer comprising cobalt on a substrate comprising nanometer-sized features by a) contacting a composition as defined herein with the substrate, and b) applying a current density to the substrate for a time sufficient to deposit a metal layer onto the substrate.

In this way additives are provided that result in a void-free filling of recessed features.

DETAILED DESCRIPTION OF THE INVENTION

Figure 1:
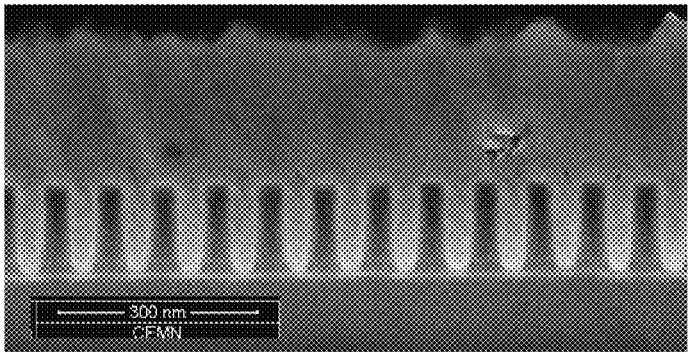
FIG. 1 shows a FIB/SEM inspected wafer that was electroplated with cobalt using an electroplating composition comprising an additive according to example 1.
Figure 2:
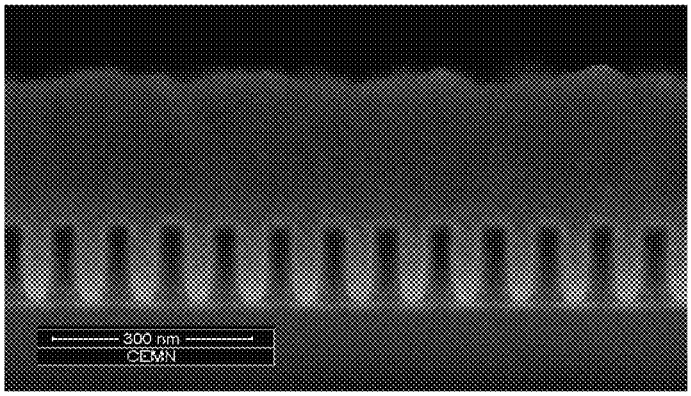
FIG. 2 shows a FIB/SEM inspected wafer that was electroplated with cobalt using an electroplating composition comprising an additive according to example 2.
Figure 3A:
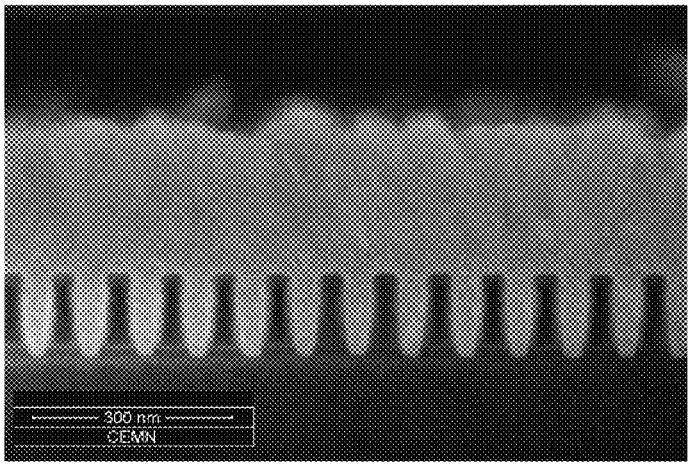
FIG. 3A shows a FIB/SEM inspected wafer that was electroplated with cobalt using an electroplating composition comprising an additive according to example 3.
Figure 3B:
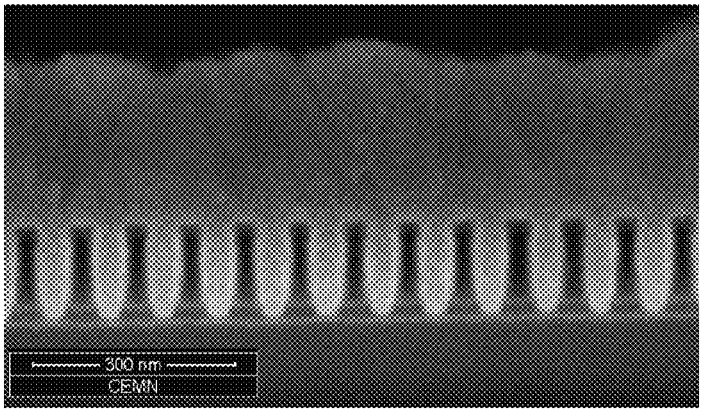
FIG. 3B shows a FIB/SEM inspected wafer that was electroplated with cobalt using an electroplating composition comprising an additive according to example 3.
Figure 3C:
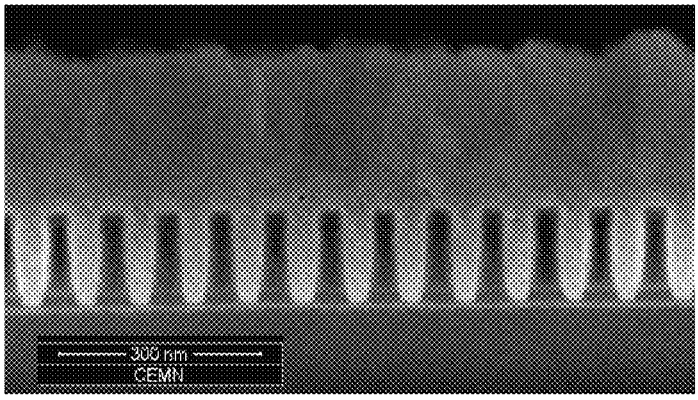
FIG. 3C shows a FIB/SEM inspected wafer that was electroplated with cobalt using an electroplating composition comprising an additive according to example 3.
Figure 3D:
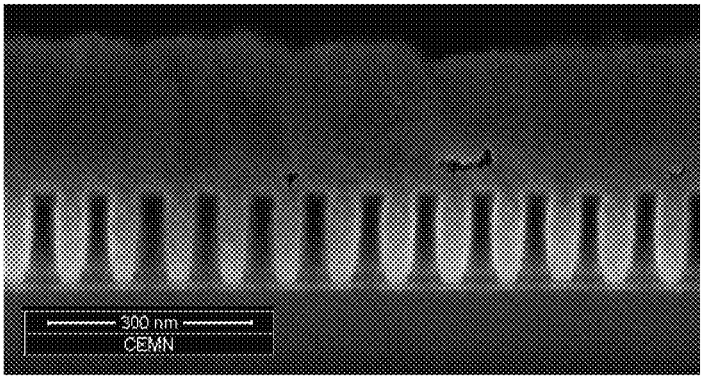
FIG. 3D shows a FIB/SEM inspected wafer that was electroplated with cobalt using an electroplating composition comprising an additive according to example 3.
Figure 4:
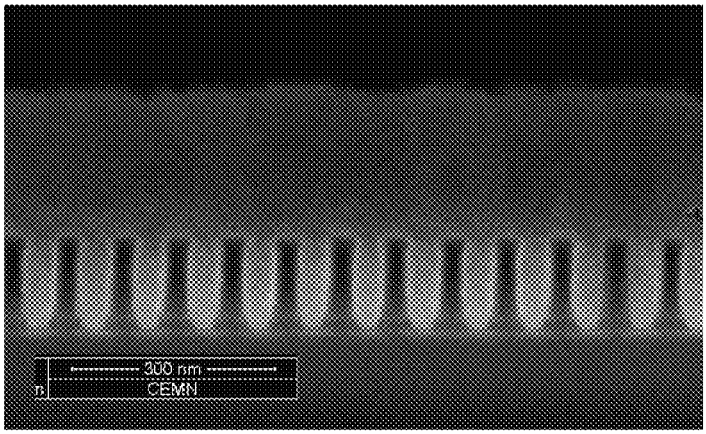
FIG. 4 shows a FIB/SEM inspected wafer that was electroplated with cobalt using an electroplating composition comprising an additive according to example 4.
Figure 5:
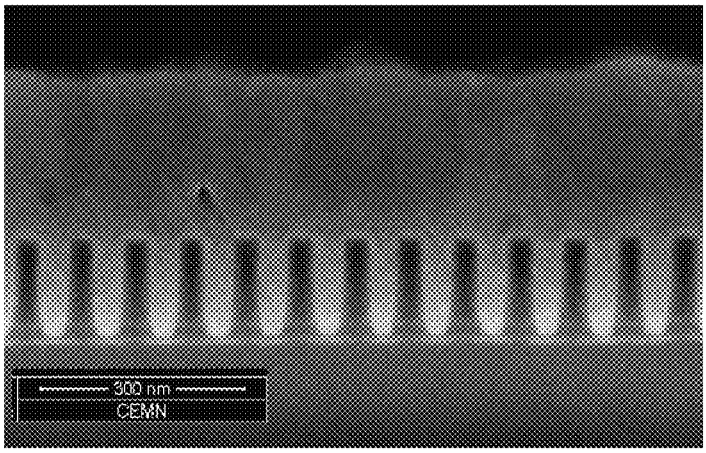
FIG. 5 shows a FIB/SEM inspected wafer that was electroplated with cobalt using an electroplating composition comprising an additive according to example 5.
Figure 6:
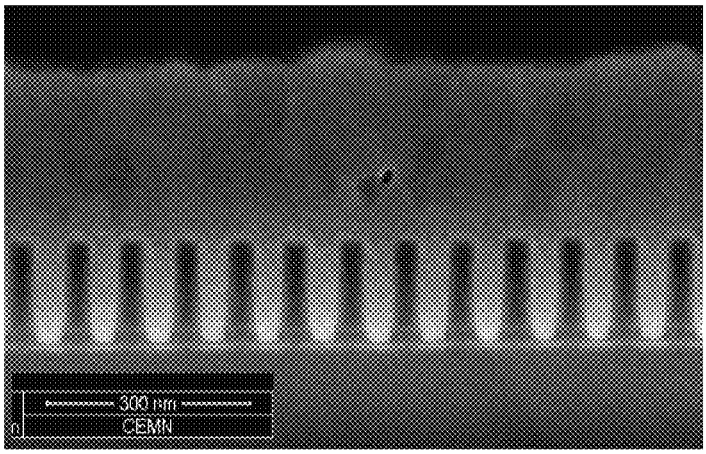
FIG. 6 shows a FIB/SEM inspected wafer that was electroplated with cobalt using an electroplating composition comprising an additive according to example 6.
Figure 7:
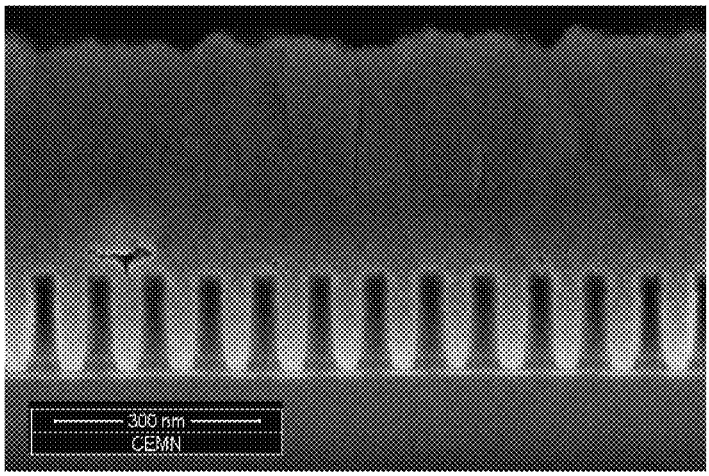
FIG. 7 shows a FIB/SEM inspected wafer that was electroplated with cobalt using an electroplating composition comprising an additive according to example 7.
Figure 8:
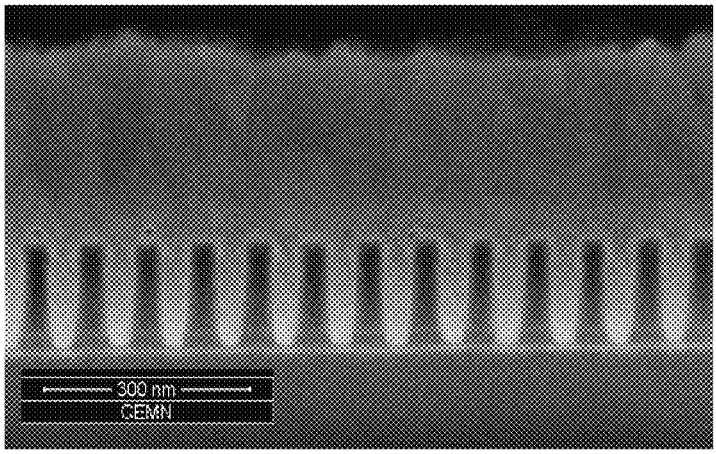
FIG. 8 shows a FIB/SEM inspected wafer that was electroplated with cobalt using an electroplating composition comprising an additive according to example 8.

The compositions according to the inventions comprise cobalt ions, and a suppressing agent of formulas S1 to S4 as described below.

Suppressing Agent According to the Invention

The composition according to the invention comprise cobalt ions, and a suppressing agent of formula S1 as described below.

As used herein a "suppressing agent" means any additive that is capable of locally suppressing the deposition of cobalt to ensure a void-free filling of the feature. Particularly, a suppressing agent leads to a bottom-up filling of recessed features comprising nanometer-sized apertures.

Particularly if the semiconductor substrate to be electroplated comprises recessed features having an aperture size below 100 nm, particularly below 50 nm, even more particular if the aspect ratio of the recessed features is 4 or more, the use of a suppressing agent is usually required.

As used herein, "suppressing agent" refers to an organic compound that decreases the plating rate of the electroplating bath on at least part of a substrate. In particular, a suppressor is an additive that suppresses the plating rate on the substrate above any recessed features. Dependent on the diffusion and adsorption the suppressor decreases the plating rate at the upper sidewalls of the recessed features. The terms "suppressor" and "suppressing agent" are used interchangeably throughout this specification.

As used herein, "feature" refers to the cavities on a substrate, such as, but not limited to, trenches and vias. "Apertures" refer to recessed features, such as vias and trenches. As used herein, the term "plating" refers to metal electroplating, unless the context clearly indicates otherwise. "Deposition" and "plating" are used interchangeably throughout this specification.

"Aperture size" according to the present invention means the smallest diameter or free distance of a recessed feature before plating, i.e. after seed deposition. The terms "width", "diameter", "aperture" and "opening" are used herein, depending on the geometry of the feature (trench, via, etc.) synonymously.

As used herein, "aspect ratio" means the ratio of the depth to the aperture size of the recessed feature.

In a first embodiment, the suppressing agent to be used in the electroplating compositions comprises the polymeric structure of formula S1

$$[B]_n[A]_p \quad (S1)$$

In a second embodiment the suppressing agent to be used in the electroplating compositions comprises the monomeric structure of formula S2

(S2)

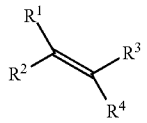

In a third embodiment the suppressing agent to be used in the electroplating compositions comprises the polymeric structure of formula S3a or S3b (S3a)

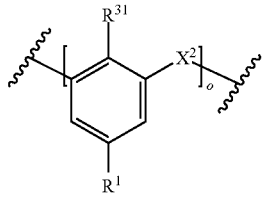

(S3b)

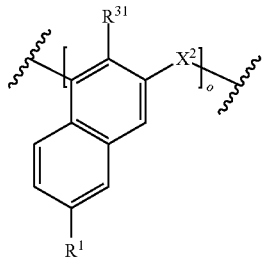

In a fourth embodiment the suppressing agent to be used in the electroplating compositions comprises the monomeric structure of formula S4

$$Ø\text{-}R^1 \quad (S4)$$

with the substituents described below.

As used herein, "aryl" means a $C_6$ to $C_{14}$ carbocyclic or a $C_3$ to $C_{10}$ nitrogen or oxygen containing heterocyclic aromatic ring system, which may be unsubstituted or substituted by up to three $C_1$ to $C_{12}$ alkyl groups or up to two OH, $NH_2$ or $NO_2$ groups.

In all embodiments, $R^1$ in formulas S1 to S4 may be selected from $X^1$—CO—O—$R^{11}$, $X^1$—$SO_2$—O—$R^{11}$, $X^1$—$PR^{11}O(OR^{11})$, $X^1$—$P(OR^{11})_2$, $X^1$—$PO(OR^{11})_2$, and $X^1$—SO—$OR^{11}$. $R^1$ is also referred to herein as "functional group".

$X^1$ may be a chemical bond, which means that the functional groups —CO—O—$R^{11}$, —$SO_2$—O—$R^{11}$, —$PR^{11}O(OR^{11})$, —$P(OR^{11})_2$, —$PO(OR^{11})_2$ and —SO—$OR^1$ are directly bonded to the polymer backbone in formula S1, the vinyl group in formula S2 or the aromatic system in formulas S3a, S3b, and S4. As used herein, "chemical bond" means that the respective moiety is not present but that the adjacent moieties are bridged so as to form a direct chemical bond between these adjacent moieties. By way of example, if in X—Y—Z the moiety Y is a chemical bond then the adjacent moieties X and Z together form a group X—Z.

In an alternative $X^1$ is a divalent aryl group. Preferred divalent aryl groups are phenylene, naphthalene, pyridine, or imidazole, particularly 1,4-phenylene.

In a further alternative $X^1$ is a divalent $C_1$ to $C_{12}$ alkanediyl group, which may be interrupted by O atoms. As used herein, "$C_x$" means that the respective group comprises x numbers of C atoms. By way of example, the terms "$C_x$ to $C_y$ alkanediyl" and $C_x$ to $C_y$ alkyl mean alk(anedi)yl with a number x to y of carbon atoms and includes linear, branched (if $>C_3$) and cyclic alkanediyl (if $>C_4$).

In yet a further alternative $X^1$ is a divalent alkylaryl group —$X^{11}$—$X^{12}$—, wherein $X^{11}$ is a $C_1$ to $C_{15}$ alkandiyl group bonded to the polymer backbone, vinyl group, or aromatic system, respectively, and $X^{12}$ is a divalent aryl group bonded to the functional group. Preferred alkylaryl groups may be but are not limited to benzyl (ortho, meta or para form) and 1, 2, or 3-methylpyridine. Preferably the alkanediyl part $X^{11}$ may be methanediyl, propanediyl, or butanediyl. Preferably the aryl part $X^{12}$ may be phenylene, naphthalene, pyridine, or imidazole, particularly 1,4-phenylene.

In another alternative $X^1$ is a divalent arylalkyl group —$X^{12}$—$X^{11}$—, wherein $X^{12}$ is a divalent aryl group bonded to the polymer backbone, vinyl group, or aromatic system, respectively, and $X^{11}$ is a $C_1$ to $C_{15}$ alkandiyl group bonded to the functional group. Preferred arylalkyl groups may be but are not limited to toluyl (ortho, meta or para form) and 1, 2, or 3-methylpyridine. Preferably the alkanediyl part $X^{11}$ may be methanediyl, propanediyl, or butanediyl. Preferably the alkanediyl part $X^{11}$ may be phenylene, naphthalene, pyridine, or imidazole, particularly 1,4-phenylene.

In yet another alternative $X^1$ is a divalent (poly)alkylene oxide spacer —$(C_2H_3R^{12}$—$O)_m$—, wherein $R^{12}$ is selected from H and $C_1$ to $C_4$ alkyl, preferably H or methyl, and m is an integer from 1 to 10, preferably from 1 to 5.

Preferably, $X^1$ is selected from a chemical bond, $C_1$ to $C_4$ alkandiyl, and phenylene.

In a preferred embodiment $R^{11}$ is selected from H and $C_1$ to $C_4$ alkyl, preferably H or methyl, most preferably H.

In the first embodiment, in formula S1 A is a co-monomeric unit derived from vinyl alcohol, which may optionally be (poly)ethyoxylated, acrylonitrile, styrene and acrylamide, and B is a monomeric unit of formula S1a (S1a)

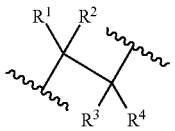

Generally, in formulas S1a and S2 of the first and the second embodiment, $R^2$, $R^3$ and $R^4$ are independently selected from $R^1$ and a group $R^R$ with $R^R$ being selected from (i) H, (ii) aryl, preferably a $C_6$ to $C_{10}$ carbocyclic aryl or a $C_3$ to C heterocyclic aryl comprising up to two N atoms, most preferably phenyl or pyridyl, (iii) $C_1$ to $C_{10}$ alkyl, preferably $C_1$ to $C_6$ alkyl, more preferably $C_1$ to $C_4$ alkyl, most preferably $C_1$ to $C_3$ alkyl, (iv) arylalkyl, preferably a $C_7$ to $C_{15}$ carbocyclic arylalkyl or a $C_4$ to C heterocyclic arylalkyl comprising up to two N atoms, more preferably $C_4$ to C arylalkyl, most preferably benzyl or 1, 2, or 3-methylpyridine, (v) alkylaryl, preferably a $C_7$ to $C_{15}$ carbocyclic alkylaryl or a $C_4$ to $C_8$ heterocyclic alkylaryl comprising up to two N atoms, more preferably $C_4$ to $C_8$ alkylaryl, most preferably toluyl (otho, meta or para form) and 1, 2, or 3-methylpyridine, or (vi) a (poly)alkylene oxide substituent —$(O—C_2H_3R^{12})_m$—OH, with m being an integer from 1 to 50, preferably 1 to 30, more preferably 1 or 2 to 20, most preferably 1 or 2 to 10, and $R^{12}$ being selected from H and $C^1$ to $C^4$ alkyl.

Since only one of $R^2$, $R^3$ and $R^4$ may comprise a group $R^1$ it is required that if one of $R^2$, $R^3$ or $R^4$ are selected from $R^1$, the other groups $R^2$, $R^3$ or $R^4$ are different from $R^1$.

In a particular embodiment, in formulas S1a and S2 of the first and the second embodiment, $R^2$ is selected from (i) H, (ii) aryl, preferably a $C_6$ to $C_{10}$ carbocyclic aryl or a $C_3$ to $C_8$ heterocyclic aryl comprising up to two N atoms, most preferably phenyl or pyridyl, (iii) $C_1$ to $C_{10}$ alkyl, preferably $C_1$ to $C_6$ alkyl, more preferably $C_1$ to $C_4$ alkyl, most preferably $C_1$ to $C_3$ alkyl, (iv) arylalkyl, preferably a $C_7$ to $C_{15}$ carbocyclic arylalkyl or a $C_4$ to $C_8$ heterocyclic arylalkyl comprising up to two N atoms, more preferably $C_4$ to $C_8$ arylalkyl, most preferably benzyl or 1, 2, or 3-methylpyridine, (v) alkylaryl, preferably a $C_7$ to $C_{15}$ carbocyclic alkylaryl or a $C_4$ to $C_8$ heterocyclic alkylaryl comprising up to two N atoms, more preferably $C_4$ to $C_8$ alkylaryl, most preferably toluyl (otho, meta or para form) and 1, 2, or 3-methylpyridine, or (vi) a (poly)alkylene oxide substituent —$(O—C_2H_3R^{12})_m$—OH, with m being an integer from 1 to 50, preferably 1 to 30, more preferably 1 or 2 to 20, most preferably 1 or 2 to 10, and $R^{12}$ being selected from H and $C^1$ to $C^4$ alkyl.

In a particular embodiment, in formulas S1a and S2, $R^3$ is selected from $R^1$ and $R^R$. $R^4$ is selected from $R^R$ and, only in case $R^3$ is not $R^1$, $R^4$ may also be $R^1$. In other words: The formulas S1a and S2 may comprise one or two functional groups $R^1$. As a consequence, the suppressing agents of formula S2 with two functional groups may have cis and trans configuration with respect to functional group $R^1$.

In another particular embodiment, $R^2$ is selected from $R^1$ and $R^3$ and $R^4$ are selected from $R^R$.

In a preferred embodiment, $R^2$, $R^3$ and $R^4$ are selected from H, methyl, ethyl, or propyl, most preferably H. In another preferred embodiment, $R^2$ and either $R^3$ or $R^4$ are selected from H, methyl, ethyl, or propyl, most preferably H and the other group $R^3$ or $R^4$ is selected from $R^1$. In another preferred embodiment, $R^2$ is selected from $R^1$ and $R^3$ and $R^4$ are selected from H, methyl, ethyl, or propyl, most preferably H.

In formula S1, n is an integer from 2 to 10 000 and p may either be 0 or an integer from 1 to 10 000.

If p is 0, the suppressing agents of formula S1 may be homopolymers, such as but not limited to polyacrylic acid, polysulfonic acid, polyphosphonic acid and the like, in which $R^2=R^3=R^4=H$, or polymaleic acid, in which $R^2=R^4=H$ and $R^3=R^1$ or $R^2=R^3=H$ and $R^4=R^1$, or polyitaconic acid, in which $R^3=R^4=H$ and $R^1=COOH$ and $R^2=CH_2COOH$. Alternatively, the suppressing agents of formula S1 may be co-polymers, such as but not limited to poly(acrylic acid-co-maleic acid), poly(acrylic acid-co-itaconic acid), poly(acrylic acid-co-2-methylacrylic acid), poly(vinylsulfonic acid-co-maleic acid), poly(vinylsulfonic acid-co-itaconic acid), poly(vinylphosphonic acid-co-maleic acid), poly(vinylphosphonic acid-co-itaconic acid), poly (vinylphosphonic acid-co-vinylsulfonic acid), and the like, in order to tune the sort and the amount of functional groups present in the suppressing agent.

Alternatively, if p>0, the polymeric suppressing agents may be co-polymers of the monomers mentioned above with further monomers like vinyl alcohol and its ethoxylated or polyethoxylated derivatives, or acrylnitrile or styrene or acrylamide. In this case the sum of n and p is the overall degree of polymerization.

The degree of polymerization n+p in formula S1 is preferably an integer from 2 to 10 000. Most preferably n+p is an integer from 10 to 5000, most preferably from 20 to 5000.

If copolymers are used, such copolymers may have block, random, alternating or gradient, preferably random structure. As used herein, "random" means that the respective co-monomers are polymerized from a mixture and therefore arranged in a statistically manner depending on their copolymerization parameters. As used herein, "block" means that the respective co-monomers are polymerized after each other to form blocks of the respective co-monomers in any predefined order.

The molecular weight $M_w$ of the polymeric suppressing agents of formula S1 may be from about 500 to about 500000 g/mol, preferably from about 1000 to about 350000 g/mol, most preferably from about 2000 to about 300000 g/mol. In one particular embodiment the molecular weight $M_w$ is from about 1500 to about 10000 g/mol. In another embodiment the molecular weight $M_w$ is from about 15000 to about 50000 g/mol. In yet another embodiment the molecular weight Mw is from about 100000 to about 300000 g/mol.

If copolymers are used, the ratio between two monomers B or the comonomers A and the monomers B in the suppressing agents of formula S1 may be from 5:95 to 95:5 by weight, preferably from 10:90 to 90:10 by weight, most preferably from 20:80 to 80:20 by weight. Also terpolymers comprising two monomers B and a comonomer A may be used.

Particularly preferred polymeric suppressing agents of formula S1 are polyacrylic acid, polyitaconic acid, a maleic acid acrylic acid copolymer, an itaconic acid acrylic acid copolymer, an acrylic acid 2-methylacrylic acid copolymer, polyvinylphosphonic acid, and polyvinylsulfonic acid. Most preferred are polyacrylic acid, a maleic acid acrylic acid copolymer and an acrylic acid 2-methylacrylic acid copolymer. In case of a maleic acid acrylic acid copolymer or an itaconic acid acrylic acid copolymer a ratio p:n of 20:80 to 60:40 by weight is particularly preferred. In case of a 2-methylacrylic acid acrylic acid copolymer a ratio p:n of 20:80 to 80:20 by weight is particularly preferred.

The following specific copolymer suppressing agents of formulas S1b to S1d are particularly preferred:

(S1b)

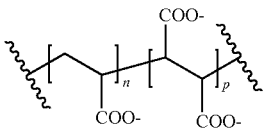

-continued (S1c)

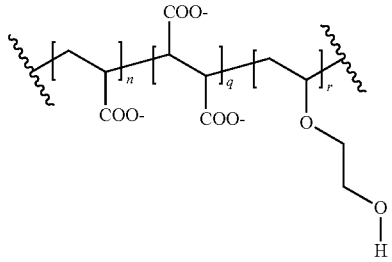

which is a terpolymer of acrylic acid, maleic acid and ethyoxylated vinyl alcohol, wherein q and r are integers, the sum q+r corresponds to p in formula 1 and the ratio q/r is from 10:90 to 90:10, preferably 20:80 to 80:20, most preferably from 40:60 to 60:40; and (S1d)

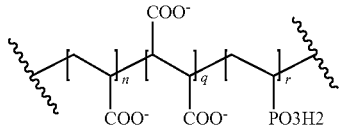

which is a terpolymer of acrylic acid, maleic acid and vinylphosponic acid, wherein q and r are integers, the sum q+r corresponds to p in formula S1, and the ratio q/r is from 10:90 to 90:10, preferably 20:80 to 80:20, most preferably from 40:60 to 60:40.

Particularly preferred monomeric suppressing agents of formula S2 are acrylic acid, vinylphosphonic acid, and vinylsulfonic acid.

In the third embodiment comprising a polymeric suppressing agents of formula S3a or S3b (together also referred to as S3) $R^{31}$ may generally be $R^1$, H, $OR^{32}$ and $R^{32}$ is selected from (i) H and (ii) $C_1$ to $C_6$ alkyl. Preferably, $R^{31}$ is H or OH. Such polymers are available in the market under napthalene sulphonic acid polymer product, Na-salt and Phenol sulfonic acid polymer product, Na-salt, e.g. from BASF.

In the suppressing agents of formula S3 $X^2$ is (i) a chemical bond or (ii) methanediyl. Preferably $X^2$ is methanediyl.

The degree of polymerization o in the suppressing agents of formula S3 is from 2 to 1000. Preferably o is an integer from 5 to 500, most preferably from 10 to 250.

The molecular weight $M_w$ of the polymeric suppressing agents S3 may be from about 500 to about 400000 g/mol, preferably from about 1000 to about 300000 g/mol, most preferably from about 3000 to about 250000 g/mol. In one particular embodiment the molecular weight $M_w$ is from about 1500 to about 10000 g/mol. In another embodiment the molecular weight $M_w$ is from about 15000 to about 50000 g/mol. In yet another embodiment the molecular weight $M_w$ is from about 100000 to about 300000 g/mol.

In the fourth embodiment, the suppressing agents of formula S4, Ø is a $C_6$ to $C_{14}$ carbocyclic or a $C_3$ to $C_{10}$ nitrogen or oxygen containing heterocyclic aryl group, which may be unsubstituted or substituted by up to three $C_1$ to $C_{12}$ alkyl groups or up to two OH, $NH_2$ or $NO_2$ groups. Preferably the heterocyclic aryl groups are 5 or 6 membered rings systems with up to 2, preferably 1, N atoms.

Preferred groups Ø are those of formula S4a (S4a)

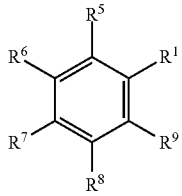

wherein $R^5$, $R^6$, $R^1$, $R^8$, and $R^9$ are independently selected from (i) H and (ii) $C_1$ to $C_6$ alkyl. Preferably $R^5$, $R^6$, $R^8$, and $R^9$ are independently selected from H, methyl, ethyl or propyl, most preferably H. Preferably $R^7$ is selected from H, methyl, ethyl or propyl, most preferably from methyl or ethyl.

In certain embodiments, the suppressor may be present in a concentration between about 1-10 000 ppm, or between about 10-1 000 ppm, or between about 10-500 ppm. In some cases, the concentration of suppressing agents may be at least about 1 ppm, or at least about 100 ppm. In these or other cases, the concentration of suppressing agents may be about 500 ppm or less, or about 1000 ppm or less. In a preferred embodiment, the suppressing agent is present in a concentration from 20 to 1 000 ppm, preferably 30 to 1 000 ppm, most preferably 40 to 1000 ppm.

Other Additives

A large variety of further additives may typically be used in the bath to provide desired surface finishes for the Co plated metal. Usually more than one additive is used with each additive forming a desired function.

The bath may also contain a complexing agent for the cobalt ions, such as but not limited to acetic acid or an acetate, citric acid or a citrate, EDTA, tartaric acid or a tartrate, or an alkylene di-, tri, or polyamine, such as but not limited to ethylene diamine.

Further additives are disclosed in Journal of the Electrochemical Society, 156 (8) D301-D309 2009 "Superconformal Electrodeposition of Co and Co—Fe Alloys Using 2-Mercapto-5-benzimidazolesulfonic Acid", which is incorporated herein by reference.

Advantageously, the electroplating baths may contain one or more of wetting agents to get rid of trapped air or hydrogen bubbles and the like. Wetting agents may be selected from nonionic surfactants, anionic surfactants and cationic surfactants. In a preferred embodiment non-ionic surfactants are used. Typical non-ionic surfactants are fluorinated surfactants, polyglycols, or poly oxyethylene and/or oxypropylene containing molecules. Particularly useful surfactants are Lutensol®, Plurafac® or Pluronic® (available from BASF).

Further components to be added are grain refiners, stress reducers and mixtures thereof.

The composition according to the invention is essentially free of any additional suppressing agent, i.e. any compound that decreases the plating rate of the electroplating bath on at least part of a substrate, in particular a compound that suppresses the plating rate on the substrate above any recessed features. In particular the composition is free of any suppressing agents selected from those of formula S5

(S5)

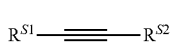

wherein $R^{S1}$ is selected from $X^S$—$Y^S$;

$R^{S2}$ is selected from $R^{S1}$ and $R^{S3}$;

$X^S$ is selected from linear or branched $C_1$ to $C_{10}$ alkanediyl, linear or branched $C_2$ to $C_{10}$ alkenediyl, linear or branched $C_2$ to $C_{10}$ alkynediyl, and $(C_2H_3R^{S6}—O)_{ms}$—H;

$Y^S$ is selected from $OR^{S3}$, $NR^{S3}R^{S4}$, $N+R^{S3}R^{S4}R^{S5}$ and NH—(C═O)—$R^{S3}$;

$R^{S3}$, $R^{S4}$, $R^{S5}$ are the same or different and are selected from (i) H, (ii) $C_5$ to $C_{20}$ aryl, (iii) $C_1$ to $C_{10}$ alkyl (iv) $C_6$ to $C_{20}$ arylalkyl, (v) $C_6$ to $C_{20}$ alkylaryl, which may be substituted by OH, $SO_3H$, COOH or a combination thereof, and (vi) $(C_2H_3R^{S6}—O)_{ns}$—H and wherein $R^{S3}$ and $R^{S4}$ may together form a ring system, which may be interrupted by O or $NR^{S7}$;

ms, ns are integers independently selected from 1 to 30;

$R^{S6}$ is selected from H and $C_1$ to $C_5$ alkyl;

$R^{S7}$ is selected from $R^{S6}$ and

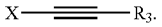

In one embodiment the cobalt electroplating composition comprises an additional leveling agent. Since the suppressing agents according to the inventions generally have suppressing as well as leveling capabilities, "additional leveling agent" here refer to a compound that it is different from the suppressing agent. As used herein, "leveling agent" refers to an organic compound that is, besides any additional functionality, capable of providing a substantially planar metal layer on the substrate. The terms "leveler", "leveling agent" and "leveling additive" are used interchangeably throughout this specification.

Leveler often contain one or more nitrogen, amine, imide or imidazole, and may also contain sulfur functional groups. Certain levelers include one or more five and six member rings and/or conjugated organic compound derivatives. Nitrogen groups may form part of the ring structure. In amine-containing levelers, the amines may be primary, secondary or tertiary alkyl amines. Furthermore, the amine may be an aryl amine or a heterocyclic saturated or aromatic amine. Example amines include, but are not limited to, dialkylamines, trialkylamines, arylalkylamines, triazoles, imidazole, triazole, tetrazole, benzimidazole, benzotriazole, piperidine, morpholines, piperazine, pyridine, oxazole, benzoxazole, pyrimidine, quonoline, and isoquinoline. Imidazole and pyridine may be useful in some cases. Other examples of levelers include Janus Green B and Prussian Blue. Leveler compounds may also include ethoxide groups. For example, the leveler may include a general backbone similar to that found in polyethylene glycol or polyethylene oxide, with fragments of amine functionally inserted over the chain (e.g., Janus Green B). Example epoxides include, but are not limited to, epihalohydrins such as epichlorohydrin and epibromohydrin, and polyepoxide compounds. Polyepoxide compounds having two or more epoxide moieties joined together by an ether-containing linkage may be useful in some cases. Some leveler compounds are polymeric, while others are not. Example polymeric leveler compounds include, but are not limited to, polyethylenimine, polyamidoamines, and reaction products of an amine with various oxygen epoxides or sulfides. One example of a non-polymeric leveler is 6-mercapto-hexanol. Another example leveler is polyvinylpyrrolidone (PVP).

Example levelers that may be particularly useful in the context of cobalt deposition in combination with the suppressing agent according to the subject invention include, but are not limited to: alkylated polyalkyleneimines; polyethylene glycol; organic sulfonates; 4-mercaptopyridine; 2-mercaptothiazoline; ethylene thiourea; thiourea; 1-(2-hydroxyethyl)-2-imidazolidinethion; sodium naphthalene 2-sulphonate; acrylamide; substituted amines; imidazole; triazole; tetrazole; piperidine; morpholine; piperazine; pyridine; oxazole; benzoxazole; quinolin; isoquinoline; coumarin and derivatives thereof.

In a preferred embodiment the composition is essentially free of any additional leveling agent.

Electrolyte

In one embodiment, the usually aqueous plating bath used for void-free filling with cobalt or cobalt alloys may contain a cobalt ion source, such as but not limited to cobalt sulfate, cobalt acetate, cobalt chloride, or cobalt sulfamate.

The cobalt ion concentration within the electroplating solution may be in a range of 0.01 to 1 mol/1. In one particular example, the ion concentration can have a range of 0.02 to 0.8 mol/1. In another particular example, the ion concentration can have a range of 0.05 to 0.6 mol/1. In another particular example, the range can be from 0.3 to 0.5 mol/1. In yet another particular example, the range can be from 0.03 to 0.1 mol/1.

In a preferred embodiment the composition is essentially free of chloride ions. Essentially free of chloride means that the chloride content is below 1 ppm, particularly below 0.1 ppm.

In general, besides the metal ions and the suppressing agent according to the present invention the present cobalt electroplating compositions preferably include an electrolyte, typically an inorganic or organic acid.

Suitable electrolytes include such as, but not limited to, sulfuric acid, acetic acid, fluoroboric acid, alkylsulfonic acids such as methanesulfonic acid, ethanesulfonic acid, propanesulfonic acid and trifluoromethane sulfonic acid, arylsulfonic acids such as phenyl sulfonic acid and toluenesulfonic acid, sulfamic acid, hydrochloric acid, and phosphoric acid. The acids are typically present in an amount required to adjust the pH to the desired value.

In a preferred embodiment boric acid may be used in the cobalt electroplating composition as supporting electrolyte.

Alternatively to boric acid, ammonium compounds of formula $(NR^1R^2R^3H^+)_nX^{n-}$ may be used, as described in European patent application No. 18168249.3. Herein, $R^1$, $R^2$, and $R^3$ are independently selected from H, linear or branched $C_1$ to $C_6$ alkyl. Preferably, $R^1$, $R^2$, and $R^3$ are independently selected from H and a linear or branched $C_1$ to $C_4$ alkyl, particularly methyl and ethyl. More preferably at least one of $R^1$, $R^2$ and $R^3$ is H, even more preferably at least two of $R^1$, $R^2$ and $R^3$ are H. Most preferably, $R^1$, $R^2$, and $R^3$ are H. X is an n valent inorganic or organic counter ion. Typical inorganic counter-ions are, without limitation, chloride, sulfate (including hydrogen sulfate), phosphate (including hydrogen and dihydrogen phosphate), and nitrate. Typical organic counter-ions are, without limitation, $C_1$ to $C_6$ alkyl sulfonate, preferably methane sulfonate, $C_1$ to $C_6$ carboxylates, preferably acetate or citrate, phosphonate, sulfamate, etc. Inorganic counter-ions are preferred. Chloride is the most preferred counter ions X since by using chloride in combination with the ammonium cation the non-uniformity of the cobalt deposit across the wafer may be further improved. n is an integer selected from 1, 2 or 3 depending on the valence of the counter-ion. By way of example, for chloride and hydrogen sulfate n would be 1, for sulfate or hydrogen phosphate n would be 2 and for phosphate n would be 3. Preferred ammonium compounds are compounds ammonium sulfate, ammonium chloride, or ammonium methane sulfonate. If an ammonium compound is used, preferably the cobalt electroplating composition is essentially free of boric acid. The ammonium compound is usually applied in concentrations of up to 33 g/l.

During deposition, the pH of the plating bath may be adjusted to have a high Faradaic efficiency while avoiding the co-deposition of cobalt hydroxides. For this purpose, a pH range of 1 to 5 may be employed. In a particular example pH range of 2 to 4.5, preferably 2 to 4 can be employed.

Cobalt electroplating compositions are typically aqueous. The water may be present in a wide range of amounts. Any type of water may be used, such as distilled, deionized or tap.

The electroplating baths of the present invention may be prepared by combining the components in any order. It is preferred that the inorganic components such as metal salts, water, electrolyte are first added to the bath vessel followed by the organic components such as suppressors, wetting agents and the like.

Typically, the plating baths of the present invention may be used at any temperature from 10 to 65 degrees C. or higher. It is preferred that the temperature of the plating baths is from 10 to 35 degrees C. and more preferably from 15 degrees to 30 degrees C.

In a preferred embodiment, the cobalt electroplating composition essentially consist of (a) metal ions consisting essentially of cobalt ions,
(b) a suppressing agent of formula S1, S2, S3, or S4,
(c) boric acid or an ammonium compound
(d) an inorganic or organic acid, and
(e) optionally a wetting agent,
(f) optionally a leveling agent different from the suppressing agent, and
(g) water Process An electrolytic bath is prepared comprising cobalt ions and at least one additive according to the invention. A dielectric substrate having the seed layer is placed into the electrolytic bath where the electrolytic bath contacts the at least one outer surface and the three dimensional pattern having a seed layer in the case of a dielectric substrate. A counter electrode is placed into the electrolytic bath and an electrical current is passed through the electrolytic bath between the seed layer on the substrate and the counter electrode. At least a portion of cobalt is deposited into at least a portion of the three-dimensional pattern wherein the deposited cobalt is substantially void-free.

The present invention is useful for depositing a layer comprising cobalt on a variety of substrates, particularly those having nanometer and variously sized apertures. For example, the present invention is particularly suitable for depositing cobalt on integrated circuit substrates, such as semiconductor devices, with small diameter vias, trenches or other apertures. In one embodiment, semiconductor devices are plated according to the present invention. Such semiconductor devices include, but are not limited to, wafers used in the manufacture of integrated circuits.

In order to allow a deposition on a substrate comprising a dielectric surface a seed layer needs to be applied to the surface. Such seed lay may consist of cobalt, iridium, osmium, palladium, platinum, rhodium, and ruthenium or alloys comprising such metals. Preferred is the deposition on a cobalt seed. The seed layers are described in detail e.g. in US20140183738 A.

The seed layer may be deposited or grown by chemical vapor deposition (CVD), atomic layer deposition (ALD), physical vapor deposition (PVD), electroplating, electro less plating or other suitable process that deposits conformal thin films. In an embodiment, the cobalt seed layer is deposited to form a high quality conformal layer that sufficiently and evenly covers all exposed surfaces within the openings and top surfaces. The high quality seed layer may be formed, in one embodiment. by depositing the cobalt seed material at a slow deposition rate to evenly and consistently deposit the conformal seed layer. By forming the seed layer in a conformal manner, compatibility of a subsequently formed fill material with the underlying structure may be improved. Specifically, the seed layer can assist a deposition process by providing appropriate surface energetics for deposition thereon.

Preferably the substrate comprises submicrometer sized features and the cobalt deposition is performed to fill the submicrometer sized features. Most preferably the submicrometer-sized features have an (effective) aperture size of 10 nm or below and/or an aspect ratio of 4 or more. More preferably the features have an aperture size of 7 nanometers or below, most preferably of 5 nanometers or below.

As used herein, "feature" or "recessed feature" refers to recessed geometries on a substrate, such as, but not limited to, trenches and vias. "Aperture" refers to the opening of the features, such as vias and trenches. As used herein, the term "plating" refers to metal electroplating, unless the context clearly indicates otherwise. "Deposition" and "plating" are used interchangeably throughout this specification.

The "aperture size" according to the present invention means the smallest diameter or free distance of a feature before plating, i.e. after seed deposition. The terms "aperture" and "opening" are used herein synonymously.

The general requirements for a process of cobalt electrodeposition on semiconductor integrated circuit substrates is described in US 2011/0163449 A1.

Typically, substrates are electroplated by contacting the substrate with the plating baths of the present invention. The substrate typically functions as the cathode. The plating bath contains an anode, which may be soluble or insoluble. Optionally, cathode and anode may be separated by a membrane. Potential is typically applied to the cathode. Sufficient current density is applied and plating performed for a period of time sufficient to deposit a metal layer, such as a cobalt layer, having a desired thickness on the substrate. Suitable current densities include, but are not limited to, the range of 0.1 to 250 mA/cm$^2$. Typically, the current density is in the range of 1 to 60 mA/cm$^2$ when used to deposit cobalt in the manufacture of integrated circuits. The specific current density depends on the substrate to be plated, the additives selected and the like. Such current density choice is within the abilities of those skilled in the art. The applied current may be a direct current (DC), a pulse current (PC), a pulse reverse current (PRC) or other suitable current. Typical temperatures used for the cobalt electroplating are from 10° C. to 50° C., preferably 20° C. to 40° C., most preferably from 20° C. to 35° C.

The electrodeposition current density should be chosen to promote the void-free, particularly the bottom-up filling behavior. A range of 0.1 to 40 mA/cm$^2$ is useful for this purpose. In a particular example, the current density can range from 1 to 10 mA/cm$^2$. In another particular example, the current density can range from 5 to 15 mA/cm$^2$.

In a preferred embodiment the applied current density is constantly increased by applying a current density ramp while filling the features in order to support the defect-free bottom-up filling behavior. In a particular example, the plating is started with an applied current density of 0.1 $mA/cm^2$ and increased during plating up to 40.0 $mA/cm^2$. In another example, the plating is started with an applied current density of 0.5 $mA/cm^2$ and increased during plating up to 20 $mA/cm^2$. In a preferred embodiment the applied current density is 1.0 $mA/cm^2$ and ramped by an increasing rate up to 10.0 $mA/cm^2$. Increasing rates might range from 5 $\mu A/(cm^2*s)$ to 400 $\mu A/(cm^2*s)$, preferably from 10 $\mu A/(cm^2*s)$ to 200 $\mu A/(cm^2*s)$, and more preferably from 20 $\mu A/(cm^2*s)$ to 100 $\mu A/(cm^2*s)$.

In general, when the present invention is used to deposit metal on a substrate such as a wafer used in the manufacture of an integrated circuit, the plating baths are agitated during use. Any suitable agitation method may be used with the present invention and such methods are well-known in the art. Suitable agitation methods include, but are not limited to, inert gas or air sparging, work piece agitation, impingement and the like. Such methods are known to those skilled in the art. When the present invention is used to plate an integrated circuit substrate, such as a wafer, the wafer may be rotated such as from 1 to 300 RPM and the plating solution contacts the rotating wafer, such as by pumping or spraying. In the alternative, the wafer need not be rotated where the flow of the plating bath is sufficient to provide the desired metal deposit.

Cobalt is deposited in apertures according to the present invention without substantially forming voids within the metal deposit.

As used herein, void-free fill may either be ensured by an extraordinarily pronounced bottom-up cobalt growth while perfectly suppressing the sidewall cobalt growth, both leading to a flat growth front and thus providing substantially defect free trench/via fill (so-called bottom-up-fill) or may be ensured by a so-called V-shaped filling.

As used herein, the term "substantially void-free", means that at least 95% of the plated apertures are void-free. Preferably that at least 98% of the plated apertures are void-free, mostly preferably all plated apertures are void-free. As used herein, the term "substantially seam-free", means that at least 95% of the plated apertures are seam-free. Preferably that at least 98% of the plated apertures are seam-free, mostly preferably all plated apertures are seam-free.

Plating equipment for plating semiconductor substrates is well known. Plating equipment comprises an electroplating tank which holds Co electrolyte and which is made of a suitable material such as plastic or other material inert to the electrolytic plating solution. The tank may be cylindrical, especially for wafer plating. A cathode is horizontally disposed at the upper part of tank and may be any type substrate such as a silicon wafer having openings such as trenches and vias. The wafer substrate is typically coated with a seed layer of Co or other metal or a metal containing layer to initiate plating thereon. An anode is also preferably circular for wafer plating and is horizontally disposed at the lower part of tank forming a space between the anode and cathode. The anode is typically a soluble anode.

These bath additives are useful in combination with membrane technology being developed by various tool manufacturers. In this system, the anode may be isolated from the organic bath additives by a membrane. The purpose of the separation of the anode and the organic bath additives is to minimize the oxidation of the organic bath additives.

The cathode substrate and anode are electrically connected by wiring and, respectively, to a rectifier (power supply). The cathode substrate for direct or pulse current has a net negative charge so that Co ions in the solution are reduced at the cathode substrate forming plated Co metal on the cathode surface. An oxidation reaction takes place at the anode. The cathode and anode may be horizontally or vertically disposed in the tank.

While the process of the present invention has been generally described with reference to semiconductor manufacture, it will be appreciated that the present invention may be useful in any electrolytic process where a substantially void-free cobalt deposit is desired. Such processes include printed wiring board manufacture. For example, the present plating baths may be useful for the plating of vias, pads or traces on a printed wiring board, as well as for bump plating on wafers. Other suitable processes include packaging and interconnect manufacture. Accordingly, suitable substrates include lead frames, interconnects, printed wiring boards, and the like.

All percent, ppm or comparable values refer to the weight with respect to the total weight of the respective composition except where otherwise indicated. All cited documents are incorporated herein by reference.

The following examples shall further illustrate the present invention without restricting the scope of this invention.

EXAMPLES

A. Example Additives

Additive 1: Copolymer of acrylic acid and maleic acid having a (mass average) molecular weight $M_w$ of 3,000 g/mol and an maleic acid content of 50% by weight.

Additive 2: Copolymer of acrylic acid and methylacrylic acid having a molecular weight $M_w$ of 20 000 g/mol and an MA content of 70% by weight.

Additive 3a: Polyacrylic acid having a molecular weight $M_w$ of 2 500 g/mol

Additive 3b: Polyacrylic acid having a molecular weight $M_w$ of 4 000 g/mol

Additive 3c: Polyacrylic acid having a molecular weight $M_w$ of 5 500 g/mol

Additive 3d: Polyacrylic acid having a molecular weight $M_w$ of 100 000 g/mol

Additive 4: Polyacrylic acid having a molecular weight $M_w$ of 250 000 g/mol

Additive 5: Polyvinylphosphonic acid having a molecular weight $M_w$ of 10 000 g/mol Additive 6: Phenylphosphinic acid having a molecular weight $M_w$ of 142 g/mol.

Additive 7: Polyacrylic acid sodium salt having a molecular weight $M_w$ of 70 000 g/mol.

Additive 8: Polyacrylic acid sodium salt having a molecular weight $M_w$ of 8 000 g/mol.

These compounds are available in the market.

B. Plating Experiments

Example 1

Plating was done using a potentiostatic setup, immersing the wafer coupon pieces in an electrolyte bath opposite a blank Co anode. The electrolyte was an aqueous Co sulfate-based solution comprised of 3 g/l cobalt, 33 g/l boric acid, and water. The electrolyte was adjusted to a pH of 2.75 with 1 M $H_2SO_4$. 5 ml/l of a 0.9 wt % solution of Additive 1 from the list under A was added to the electrolyte as listed in Table 1. The electrolyte was maintained at 25° C. with a pH of 2.75. A patterned wafer coupon bearing trench features of about 30 nm half-high width and an aspect ratio of about 5 was immersed in the electrolyte solution at −1V potentiostatic entry for 0.5 s before galvanostatic control was enabled. Galvanostatic plating then proceeded in a two-step process: Step 1 with an applied current density of 1-5.5 $mA/cm^2$ using an increasing rate of 25 $\mu A/(cm^2*s)$ to deposit 0.7 $C/cm^2$ wherein the wafer coupon cathode was rotated at 100 rpm, and step 2 with an applied current density of 10 $mA/cm^2$ for 90 s wherein the wafer coupon was rotated at 25 rpm. The plating conditions were selected for optimal fill with an additive containing bath, and plating was done with baths incorporating the invented additive only.

The cobalt deposit on the patterned coupon was investigated by FIB/SEM and the corresponding image is shown in FIG. 1. FIG. 1 shows a cobalt gap filling of the features which is almost free of defects.

Examples 2 to 8

Example 1 was repeated with the respective additive added to the plating bath at a dosing specified in Table 1.

The results are summarized in Table 1 and depicted in FIGS. 1 to 8. FIGS. 1 to 8 show that the cobalt deposition provides the desired gapfill behaviour. This can be derived from the predominantly defect-free filling of the features.

TABLE 1

| Example | Additive | Additive dose [ml/l] | concentration of additive formulation [wt %] | Additive concentration [ppm] | Fig. of FIB/SEM |
|---|---|---|---|---|---|
| 1 | Additive 1 | 5.0 | 0.9 | 45 | 1 |
| 2 | Additive 2 | 2.5 | 0.9 | 22.5 | 2 |
| 3a | Additive 3a | 5.0 | 0.9 | 45 | 3a |
| 3b | Additive 3b | 5.0 | 0.9 | 45 | 3b |
| 3c | Additive 3c | 5.0 | 0.9 | 45 | 3c |
| 3d | Additive 3d | 5.0 | 0.9 | 45 | 3d |
| 4 | Additive 4 | 5.0 | 0.9 | 45 | 4 |
| 5 | Additive 5 | 5.0 | 0.9 | 45 | 5 |
| 6 | Additive 6 | 5.0 | 0.9 | 45 | 6 |
| 7 | Additive 7 | 10.0 | 0.9 | 90 | 7 |
| 8 | Additive 8 | 5.0 | 0.9 | 45 | 8 |

The invention claimed is:

1. A composition for cobalt electroplating consisting essentially of:

(a) cobalt ions, (b) from 1 ppm to 1000 ppm, relative to a total weight of the composition, of a suppressing agent of formula S1

$$[B]_n[A]_p \quad (S1)$$

or of formula S2

(S2)

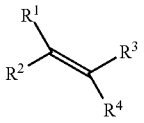

or of formula S3a or S3b (S3a)

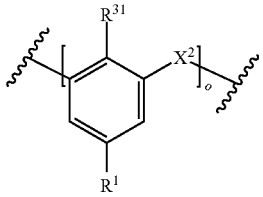

(S3b)

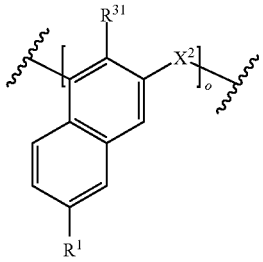

or of formula S4

$$Ø\text{-}R^1 \quad (S4)$$

and their salts, (c) boric acid, (d) an inorganic or organic acid, (e) optionally a wetting agent, (f) optionally a leveling agent different from the suppressing agent, and (g) water, wherein $R^1$ is selected from the group consisting of $X^1$—CO—O—$R^{11}$, $X^1$—$SO_2$—O—$R^{11}$, $X^1$—$PR^{11}O(OR^{11})$, $X^1$—$P(OR^{11})_2$, $X^1$—$PO(OR^{11})_2$, and $X^1$—SO—O—$R^{11}$;

$R^2$, $R^3$, $R^4$ are independently selected from the group consisting of $R^1$ and (i) H, (ii) aryl, (iii) $C_1$ to $C_{10}$ alkyl (iv) arylalkyl, (v) alkylaryl, and (vi) —$(O—C_2H_3R^{12})_m$—OH, wherein if one of $R^2$, $R^3$ or $R^4$ are selected from the group consisting of $R^1$, each other one of $R^2$, $R^3$ or $R^4$ is different from $R^1$, Ø is a $C_6$ to $C_{14}$ carbocyclic or a $C_3$ to $C_{10}$ nitrogen or oxygen containing heterocyclic aryl group, which may be unsubstituted or substituted by up to three $C_1$ to $C_{12}$ alkyl groups or up to two OH, $NH_2$ or $NO_2$ groups, $R^{31}$ is selected from the group consisting of $R^1$, H, $OR^{32}$ and $R^{32}$, $R^{32}$ is selected from the group consisting of (i) H and (ii) $C_1$ to $C_6$ alkyl, $X^1$ is a divalent group selected from the group consisting of (i) a chemical bond (ii) aryl, (iii) $C_1$ to $C_{12}$ alkanediyl, which may be interrupted by one or more O atoms, (iv) an arylalkyl group —$X^{12}$—$X^{11}$—, (v) an alkylaryl group —$X^{11}$—$X^{12}$—, and (vi) —(O—$C_2H_3R^{12})_m$O—, $X^2$ is (i) a chemical bond or (ii) methanediyl, $R^{11}$ is selected from the group consisting of H and $C_1$ to $C_4$ alkyl, $R^{12}$ is selected from the group consisting of H and $C_1$ to $C_4$ alkyl, $X^{12}$ is a divalent aryl group, $X^{11}$ is a divalent $C_1$ to $C_{15}$ alkanediyl group, A is a co-monomer selected from the group consisting of vinyl alcohol, which may optionally be (poly)ethyoxylated, acrylonitrile, styrene and acrylamide, B is selected from the group consisting of formula Sla (S1a)

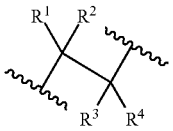

n is an integer from 2 to 10 000, m is an integer from 2 to 50, o is an integer from 2 to 1 000, and p is 0 or an integer from 1 to 10 000;

wherein the composition facilitates substantially void-free, bottom up filling of a recessed feature on a semiconductor substrate with cobalt, the recessed feature having an aperture size below 100 nm.

2. The composition according to claim 1, wherein $R^2$, $R^3$ and $R^4$ are selected from the group consisting of H, methyl, ethyl, and propyl.

3. The composition according to claim 1, wherein $R^2$ and either $R^3$ or $R^4$ are selected from the group consisting of H, methyl, ethyl, and propyl, and the other group $R^3$ or $R^4$ is selected from the group consisting of $R^1$.

4. The composition according to claim 1, wherein $R^3$ and $R^4$ are selected from the group consisting of H, methyl, ethyl, and propyl, and $R^2$ is selected from the group consisting of $R^1$.

5. The composition according to claim 1, wherein $R^{11}$ is H.

6. The composition according to claim 1, wherein n+p is an integer from 10 to 5000 and m is an integer from 2 to 30.

7. The composition according to claim 1, wherein the suppressing agent is selected from the group consisting of polyacrylic acid, polyitaconic acid, a maleic acid acrylic acid copolymer, a methacrylic acid acrylic acid copolymer, an itaconic acid acrylic acid copolymer, polyvinylphosphonic acid, and polyvinylsulfonic acid.

8. The composition according to claim 1, wherein the suppressing agent is selected from the group consisting of acrylic acid, itaconic acid, vinylphosphonic acid, phenylphosphinic acid, and vinylsulfonic acid.

9. The composition according to claim 1, wherein $R^1$ is a sulfonate group and $R^{31}$ is OH.

10. The composition according to claim 1, wherein the suppressing agent is selected from the group consisting of p-toluol sulfinate and p-toluol sulfonate.

11. The composition according to claim 1, wherein the suppressing agent is present in an amount of from 20 to 1000 ppm, relative to the total weight of the composition.

12. The composition according to claim 1, wherein the suppressing agent is present in an amount of from 30 to 1000 ppm, relative to the total weight of the composition.

13. The composition according to claim 1, wherein the suppressing agent is a compound of formula S4a (S4a)

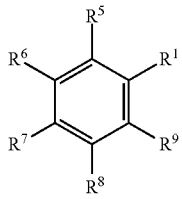

wherein $R^5$, $R^6$, $R^7$, $R^8$, and $R^9$ are independently selected from the group consisting of (i) H and (ii) $C_1$ to $C_6$ alkyl.

14. The composition according to claim 13, wherein $R^5$, $R^6$, $R^7$, $R^8$, and $R^9$ are independently selected from the group consisting of H, methyl, ethyl and propyl.

15. A method of using a compound of formula S1

$$[B]_n[A]_p \quad \text{(S1)}$$

or of formula S2

(S2)

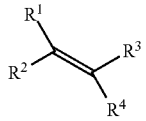

or of formula S3a or S3b (S3a)

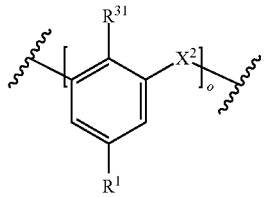

(S3b)

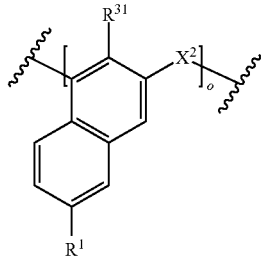

or of formula S4

$$Ø\text{-}R^1 \quad (S4)$$

and their salts, the method comprising using the compound as a suppressing agent for void-free deposition of a metal comprising cobalt on a semiconductor substrate comprising recessed features having an aperture size below 100 nm, wherein $R^1$ is selected from the group consisting of $X^1$—CO—O—$R^{11}$, $X^1$—$SO_2$—O—$R^{11}$, $X^1$—$PR^{11}O(OR^{11})$, $X^1$—$P(OR^{11})_2$, $X^1$—$PO(OR^{11})_2$, $X^1$—SO—O—$R^{11}$;

$R^2$, $R^3$, $R^4$ are independently selected from the group consisting of $R^1$ and (i) H, (ii) aryl, (iii) $C_1$ to $C_{10}$ alkyl (iv) arylalkyl, (v) alkylaryl, and (vi) —$(O—C_2H_3R^{12})_m$—OH, wherein if one of $R^2$, $R^3$ or $R^4$ are selected from the group consisting of $R^1$, each other one of $R^2$, $R^3$ or $R^4$ is different from $R^1$ Ø is a $C_6$ to $C_{14}$ carbocyclic or a $C_3$ to $C_{10}$ nitrogen or oxygen containing heterocyclic aryl group, which may be unsubstituted or substituted by up to three $C_1$ to $C_{12}$ alkyl groups or up to two OH, $NH_2$ or $NO_2$ groups, $R^{31}$ is selected from the group consisting of $R^1$, H, $OR^{32}$ and $R^{32}$, $R^{32}$ is selected from the group consisting of (i) H and (ii) $C_1$ to $C_6$ alkyl, $X^1$ is a divalent group selected from the group consisting of (i) a chemical bond (ii) aryl, (iii) $C_1$ to $C_{12}$ alkanediyl, which may be interrupted by O atoms, (iv) arylalkyl group —$X^{11}$—$X^{12}$—, (v) alkylaryl group —$X^{12}$—$X^{11}$—, and (vi) —$(O—C_2H_3R^{12})_m$O—, $X^2$ is (i) a chemical bond or (ii) methanediyl, $R^{11}$ is selected from the group consisting of H and $C_1$ to $C_4$ alkyl, $R^{12}$ is selected from the group consisting of H and $C_1$ to $C_4$ alkyl, $X^{12}$ is a divalent aryl group, $X^{11}$ is a divalent $C_1$ to $C_{15}$ alkanediyl group, A is a co-monomer selected from the group consisting of vinyl alcohol, which may optionally be (poly)ethyoxylated, acrylonitrile, styrene and acrylamide, B is selected from the group consisting of formula Sla (S1a)

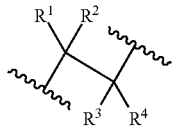

n is an integer from 2 to 10 000, m is an integer from 2 to 50, o is an integer from 2 to 1 000, and p is 0 or an integer from 1 to 10 000.

16. A process for depositing cobalt on a semiconductor substrate comprising a recessed feature having an aperture size below 100 nm the process comprising (a) bringing a composition according to claim 1 into contact with the semiconductor substrate, and (b) applying an electrical potential for a time sufficient to fill the recessed feature with cobalt.

17. The process according to claim 16, wherein in step (b) a current density is ramped up from 0.1 $mA/cm^2$ up to 40 $mA/cm^2$ by applying an increasing rate that ranges from 5 $\mu A/(cm^2*s)$ to 400 $\mu A/(cm^2*s)$.

18. The process according to claim 16, comprising a step (a1) comprising depositing a cobalt seed on a dielectric surface of the recessed feature before step (a).

19. The process according to claim 16, wherein the recessed feature has an aperture size of 30 nm or below.

* * * * *